United States Patent [19]

Damrau

[11] Patent Number: 4,859,507

[45] Date of Patent: Aug. 22, 1989

[54] HIGH SPEED PAPER COATERS

[75] Inventor: Wayne A. Damrau, Wisconsin Rapids, Wis.

[73] Assignee: Consolidated Papers, Inc., Wisconsin Rapids, Wis.

[21] Appl. No.: 127,399

[22] Filed: Dec. 2, 1987

[51] Int. Cl.[4] ..... B05D 3/12

[52] U.S. Cl. ..... 427/356; 118/126; 118/410; 118/413

[58] Field of Search ..... 118/126, 123, 410, 413; 427/356, 358

[56] References Cited

U.S. PATENT DOCUMENTS 4,310,573 1/1982 Damrau ..... 118/249 X 4,712,506 12/1987 Rantanen et al. ..... 118/126 X

*Primary Examiner*—Shrive Beck

*Assistant Examiner*—Alain Bashore

*Attorney, Agent, or Firm*—Juettner Pyle Lloyd & Verbeck

[57] ABSTRACT

A coater for applying liquid coating material onto a paper web carried across an upstream dip roll applicator that applies an excess layer of coating onto the surface of the web, is cahracterized by an improved downstream doctor assembly for metering and leveling the coating of the web. The doctor assembly includes a doctor blade having a top extended agianst and across the web, and a shear plate just upstream of the blade. The shear plate has a surface facing toward but spaced from the web and a ramp on the surface extending toward the web. As the coating layer on the web contacts the doctor blade, excess coating removed from the web by the blade bounces back off of the blade, flows across the shear plate surface and is deflected by the ramp against the web to rewet the excess coating layer on the web before it reaches the blade. The energy of the rewetting flow is sufficient to smooth and eliminate film split or streaking patterns that occur in excess coating applied with a dip roll applicator, so that there is a much more uniform coating on the resulting paper sheet.

25 Claims, 5 Drawing Sheets

HIGH SPEED PAPER COATERS

BACKGROUND OF THE INVENTION

The present invention relates to paper coaters generally, and in particular to an improved dip roll coating system, in which film split and streaking patterns in a coating applied onto a paper web are substantially eliminated.

Paper coating processes continue to be performed at faster web speeds to increase productivity. At the same time, paper quality continues to rise because of printer demands, necessitating increasingly higher coat weights to produce paper of the required quality.

The standard paper coating system for high cost weights and high web speeds has been the dip roll coater. Essentially, to apply a high weight of coating material onto the surface of a paper web traveling at a high rate of speed, for example at 2500 fpm and faster, a dip roll applicator applies an excess of coating onto the web as it is carried through a nip between the dip roll and a backing roll and, downstream from the dip roll, the coating is doctored on the web by a blade. At high web speeds, a dip roll produces a severe film split pattern in the excess layer of coating applied onto the web, i.e., separations or thin areas occur in the coating, extending along the direction of web travel. When the nonuniform layer of excess coating is doctored by the blade, it exerts varying impulse forces against the blade, and is doctored nonuniformly. In consequence, the film split pattern is not removed by the blade and appears as narrow machine direction banding in the finished sheet, and the higher the coat weight and faster the web speed, the more pronounced is the film split pattern in the finished sheet.

A dip roll coater also is commonly used to apply high coat weights at somewhat slower web speeds, for example on the order of 1200–1600 fpm. In this case, a backing roll often is not used to define with the dip roll a nip through which the web passes, but instead a "kiss coater" arrangement may be used, in which the web is simply carried under tension across the dip roll surface for receiving an excess of coating from the surface. The dip roll usually is rotated so that its surface moves in the same direction as but slower than web travel, and downstream from the roll the excess coating is doctored on the web by a blade. A problem encountered is that coating picked up on the dip roll surface for transfer to the web is not uniform and level, but instead is wavy and defines crests and troughs. Absent a backing roll for pressing the web against the dip roll, the web tends to ride on the crests as it is carried across the dip roll, so the excess coating layer is transferred to the web is nonuniform and blotchy. When the nonuniform and blotchy layer of coating is doctored by the blade, it is doctored nonuniformly, and a streaking pattern occurs in the coating on the finished paper sheet.

OBJECTS OF THE INVENTION

An object of the present invention is to provide an improved doctor assembly for a dip roll paper coater, which substantially eliminates film split and streaking patterns in excess coating applied onto a paper web.

Another object is to provide such a doctor assembly, which substantially eliminates film split and streaking patterns by rewetting the excess coating layer on the web, just prior to a doctor blade, with coating removed from the web by the blade.

A further object is to provide such a doctor assembly in which a shear plate, just upstream of the doctor blade, directs excess coating removed from the web by the blade against the web to rewet the web.

SUMMARY OF THE INVENTION

In accordance with the present invention, there is provided a doctor assembly for metering and leveling an excess layer of liquid coating material carried on a surface of a paper web traveling at a relatively high rate of speed. The doctor assembly comprises a doctor blade having a tip extended against and across the web for doctoring the excess coating layer on the web, and a shear plate upstream of the doctor blade. The shear plate has a surface facing toward but spaced from the web and a ramp on the surface extending toward the web. As the excess coating layer on the web contacts the doctor blade, because of the speed of travel of the web, coating removed from the web by the blade rebounds off of the blade in the upstream direction, flows across the shear plate surface and is deflected by the ramp against the excess coating layer on the web along a transverse application line upstream of the blade. The flow of coating rewets and smooths the excess coating layer on the web before it reaches the doctor blade, so the excess coating layer doctored by the blade is very uniform and the blade doctors the coating on the web very uniformly. The invention also contemplates paper coaters using the doctor assembly.

According to a method of metering and leveling an excess layer of coating liquid on a surface of a moving web of paper, included are the steps of extending the tip of a doctor blade against and transversely across the surface of the web to doctor the coating on and remove excess coating from the surface, and moving the web at a speed of travel sufficient to cause excess coating contacting and removed from the web by the blade to rebound off of the blade and flow in an upstream direction. Also included is the step of directing the excess flow of bladed coating against the excess layer of coating on the web, along an application line extending transversely of the web upstream of the doctor blade, to rewet and smooth the excess coating layer on the web before it reaches the blade. In this manner, the excess coating layer doctored by the blade is very uniform and the blade doctors the coating on the web very uniformly.

The foregoing and other objects, advantages and features of the invention will become apparent upon a consideration of the following detailed description, when taken in conjunction with the accompanying drawings.

DETAILED DESCRIPTION

Figure 1:
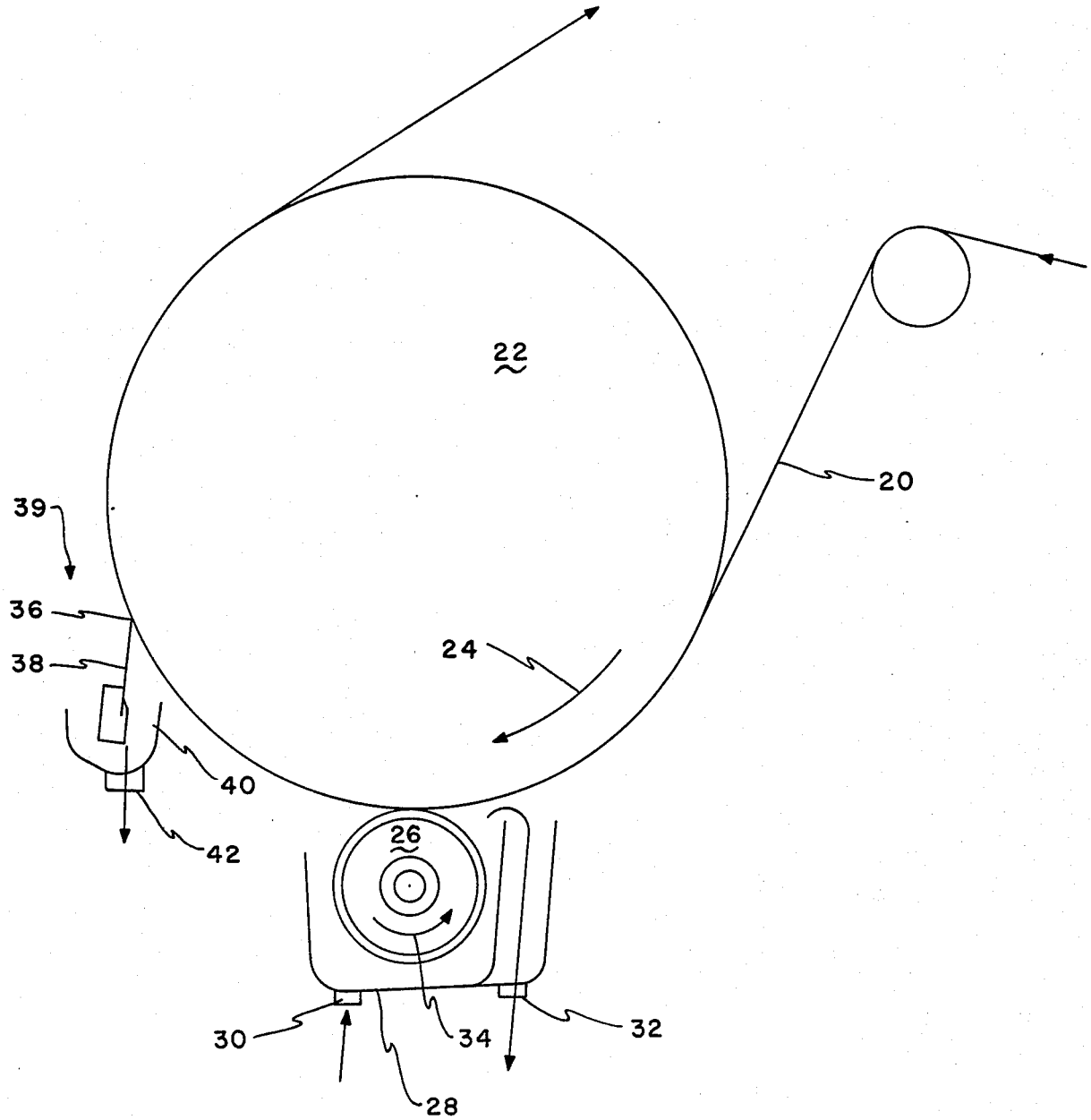
FIG. 1 PRIOR ART
FIG. 1 illustrates a conventional prior art dip roll paper coater.

FIG. 1 illustrates a conventional dip roll paper coater for applying liquid coating material onto a surface of a web of paper 20 carried on a backing roll 22 in a direction shown by an arrow 24. The system includes a dip roll applicator 26, mounted for rotation in a pan 28 having an inlet 30 through which coating liquid is introduced to maintain a reservoir of coating in contact with the roll, and an outlet 32 through which excess coating leaves the pan. The backing and dip rolls extend transversely of the web in the cross machine direction, and the dip roll is rotated in a direction indicated by an arrow 34, so that coating in the pan picked up on its surface is carried and transferred to the surface of the web as the web passes through a nip between the dip and backing rolls. The dip roll transfers and excess of coating to the web, and downstream from the dip roll, in the direction of web travel, a tip 36 of a doctor blade 38 of a doctor assembly 39 extends against and transversely across the web to meter and level coating on the web. Excess coating removed by the blade flows into a basin 40 and through an outlet 42 for return to a main supply of coating.

Paper coating processes continue to be performed at faster web speeds to increase productivity, and paper quality continues to rise because of printer demands, necessitating higher coat weights to achieve the required quality. The standard coating system for high coat weights and high web speeds has been the dip roll coater, such as that of FIG. 1. However, at high web speeds on the order of 2500–3000 fpm and faster, the excess coating layer applied onto the web 20 by the dip roll 26 develops a severe film split pattern, i.e., separations or thin layers occur in the coating, extending in the machine direction along the direction of web travel. When the nonuniform excess layer of coating is doctored at the blade 36, it is doctored nonuniformly, due to varying impulse forces of the coating against the blade. The result is a film split pattern in the finished sheet, that appears as narrow machine direction banding, and the higher the coat weight and faster the speed of travel of the web, the more pronounced is the film split pattern.

A dip roll coating system also is commonly used to apply high coat weights at somewhat slow web speeds, for example on the order of 1200–1600 fpm. In this case, the backing roll 22 often does not define with the dip roll 26 a nip through which the web 20 passes, but instead a "kiss coater" arrangement is used, in which the web is simply carried under tension across the dip roll surface for receiving an excess of coating from the surface. The dip roll usually is rotated so that its surface moves in the same direction as but slower than web travel, and downstream from the roll the excess coating is doctored on the web by the blade 36. A problem encountered is that coating picked up on the dip roll surface for transfer to the web is not uniform and level, but instead is wavy and defines crests and troughs. Absent use of the backing roll to press the web against the dip roll, the web tends to ride on the crests as it is carried across the dip roll, so the excess coating layer is transferred to the web is nonuniform and blotchy. When the nonuniform and blotchy layer of coating is doctored by the blade, it is doctored nonuniformly, and a streaking pattern occurs in the coating on the finished paper sheet.

In overcoming these disadvantages of dip roll paper coating systems, and to enable the same to apply coating onto a paper webs without occurrence of film split or streaking patterns in the finished sheet, the invention contemplates a novel doctor assembly in which a "jump shear plate" is just upstream of a doctor blade. As the excess coating layer carried by the web contacts the blade, because of the relatively high speed of travel of the web, excess coating removed by the blade bounces back away from the blade in an upstream direction and flows across the shear plate and a ramp of the shear plate. The ramp deflects the coating flow toward and against the web, along an application contact line extending transversely of the web, to rewet the excess coating layer on the web, which has yet to reach the doctor blade. The energy of the rewetting flow impacted against the web is sufficient to smooth and eliminate, or at least substantially minimize, nonuniformities in the excess coating layer just upstream of the doctor blade, resulting in a much more uniform coating layer on the web for being doctored by the blade. In consequence, variations in impulse forces of the coating layer against the blade are minimized, the blade doctors the coating very uniformly, and a high coat weight may be applied onto the web without film split or streaking patterns appearing on the finished sheet.

Figure 2:
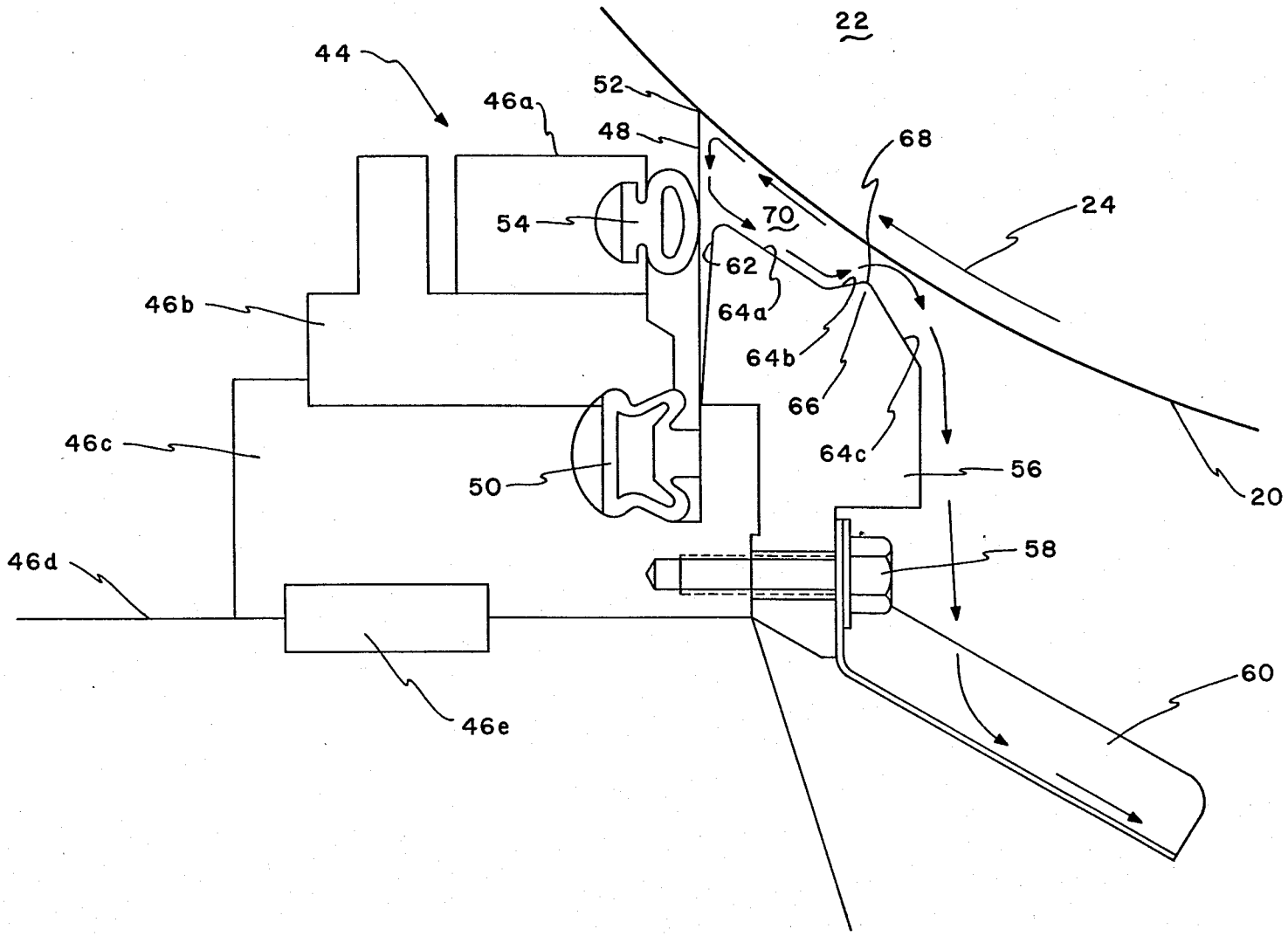
FIG. 2 shows an improved doctor assembly for a dip roll paper coater, which includes a shear plate, just upstream of a doctor blade, configured in accordance with one embodiment of the invention.

FIG. 2 illustrates a doctor assembly, indicated generally at 44, according to one embodiment of the invention. The doctor assembly is downstream of the dip roll 26 in place of the conventional assembly 39, it extends transversely across the web 20 in the cross machine direction, and includes frame members **46*a–e*. A doctor blade 48 is clamped at its lower end to the frame by a pneumatic tube 50, and a tip 52 of the blade is urged against the web with a force controlled by the pressure in a pneumatic tube 54. A shear plate 56 is mounted on the frame member 46*c* just upstream of the blade by a plurality of fasteners 58, and a coating material drain channel 60 is carried by the shear plate. A downstream surface 62** of the shear plate forms an angle of about 2° to 5° with the blade, as unloaded, to provide relief for loading the blade, it being understood that the extent of relief provided depends on blade thickness and tip loading for a given coat weight.

The upper surface of the shear plate 56 facing the web 20 is configured to define a generally planar downstream surface **64*a*, a generally planar surface 64*b* upstream and extending out of the plane of the surface 64*a* toward the web 20, and a surface 64*c* upstream and extending out of the plane of the surface 64*b* away from the web. The surfaces 64*b* and 64*c* define a ramp 66 on the upper surface of the shear plate, and meet at a ramp tip 68** that is spaced from the web.

In operation of the doctor assembly 44, as the excess coating layer applied onto the web 20 by the upstream dip roll contacts the doctor blade 48, because of the relatively high speed of travel of the web, excess coating bladed from the web rebounds off of or bounces back away from the blade and flows in the upstream direction across the shear plate surface **64*a*. Upon encountering the ramp surface 64*b*, the coating flow is deflected toward the web, and flows along and leaves the surface 64*b* at the tip 68 for impact against the web, along an application contact line extending transversely of the web, to rewet the excess layer applied onto the web by the dip roll, which excess layer has yet to reach the doctor blade. The energy of the rewetting coating flow directed against the web is sufficient to smooth and eliminate, or at least substantially minimize, nonuniformities such as film split and streaking patterns in the excess coating layer on the web upstream of the doctor blade, resulting in a much more uniform coating on the web for being doctored by the blade. In consequence, variations in the impulse forces exerted by the coating layer on the web against the blade are minimized, the blade doctors the coating very uniformly, and a high coat weight may be applied onto the web without coating nonuniformities appearing on the finished sheet. After impacting against the web, the excess coating flow bounces off of the web and flows across the shear plate surface 64c to the drain channel 60** for return to the main supply of coating.

The center of an area 70 between the web 20, doctor blade 48 and upper surface of the shear plate 56 must be maintained clear of coating material so that a puddle in which there is an eddy flow of coating does not develop adjacent the upstream side of the blade tip and cause streaking on the finished sheet. A determining factor in maintaining the center of the area free of coating is the size of the gap between the ramp tip 68 and web, and depending upon the viscosity of the coating and speed of travel of the web, it is contemplated that the gap be on the order of $\frac{1}{8}''$ to $\frac{1}{2}''$. The less viscous the coating the smaller the gap may be, and the more viscous the larger the gap may be. On the other hand, the faster the speed of travel of the web the wider the gap may be, while the slower the speed the smaller the gap can be. Proper gap size is therefore influenced by both coating viscosity and web speed. For viscosities and speeds normally encountered in such coating operations, the size of the gap will usually be on the order of 3/16" to $\frac{3}{8}''$.

In addition to the size of the gap between the ramp tip 68 and web 20, another factor influencing an absence of coating in the center of the area 70 is the relationship of the included angle between the shear plate surface 64a and 64b to the head angle, the latter of which is the angle between the unloaded doctor blade and a tangent to the backing roll 22 at the point of blade tip contact. If the shear plate surface 64b is angled too steeply toward the web, the area will fill with excess coating removed by the blade. On the other hand, if the surface is not angled steeply enough toward the web, coating flowing over and leaving the surface at the tip 68 will not strongly impact against and rewet the excess coating layer on the web, and nonuniformities in the excess coating layer will not be eliminated. The deflection angle must therefore be chosen to be neither too steep nor too shallow. With the surface 64a extending in a plane such that a perpendicular from the midpoint of its length would pass close to or through the center of the backing roll 22, it has been found that for a 45° head angle, an included angle of about 135° between the surfaces 64a and 64b will result in proper rewetting of the excess layer on the web without excess accumulation of coating in the center of the area 70.

Figure 3:
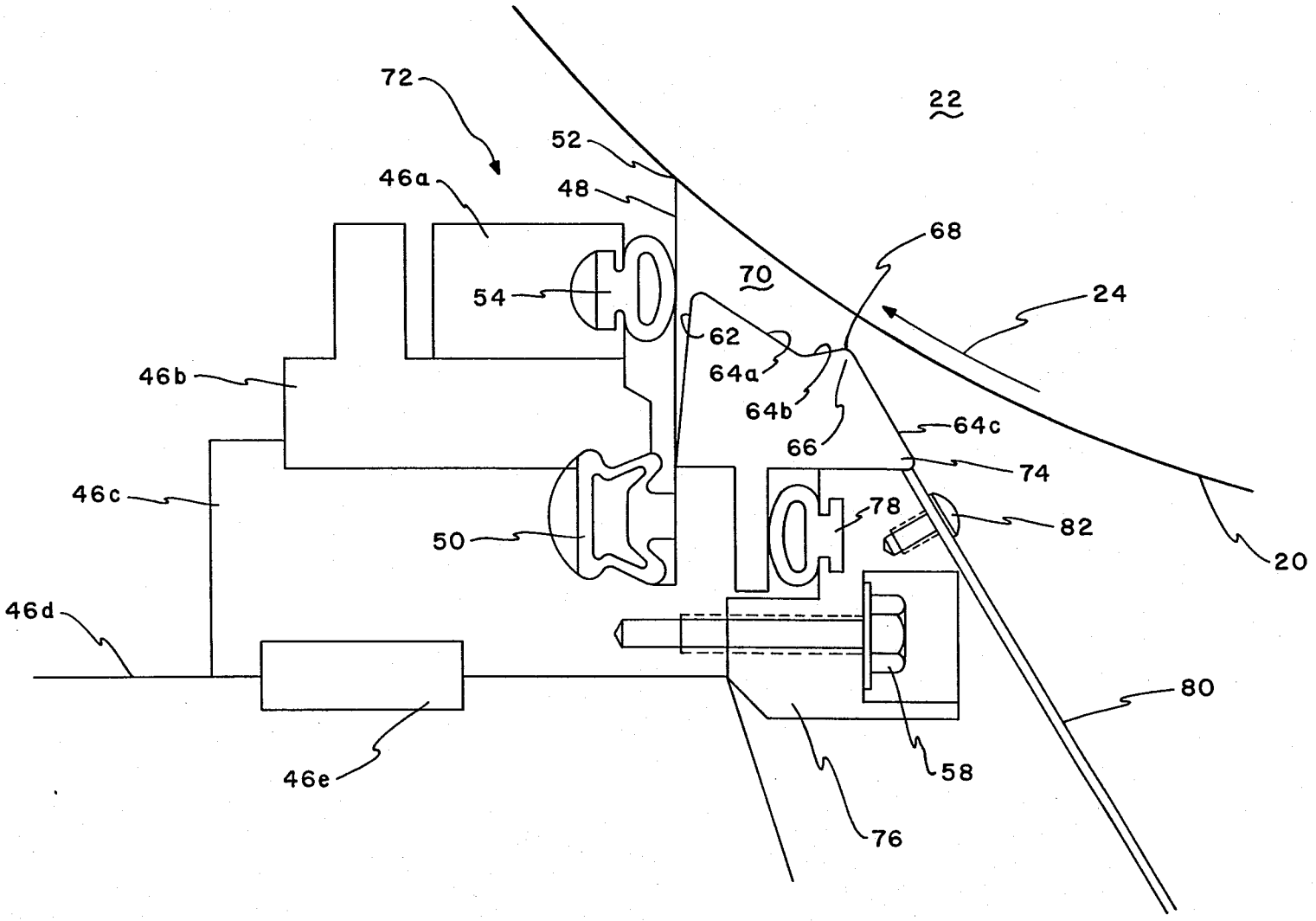
FIG. 3 is similar to FIG. 2, except that the shear plate is mounted in a manner facilitating its removal for cleaning.

FIG. 3 shows a doctor assembly 72 that is similar to that assembly 44, and for which like reference numerals have been used to denote like components. In this case, a shear plate 74 is readily removable from the assembly for cleaning. For the purpose, the bolts 58 do not mechanically attach the shear plate to the frame member 46c, but instead mount a block 76 on the member, and the block supports a pneumatic tube 78 that is inflatable to clamp the shear plate to and deflatable to release the shear plate from the member for removal. To convey runoff coating away from the shear plate, a drain ramp 80 is connected to the block by a plurality of fasteners 82. In operation, the doctor assembly 72 functions identically to the doctor assembly 44, and directs a flow of bladed coating into rewetting impingement against the excess coating layer on the web 20.

Figure 4:
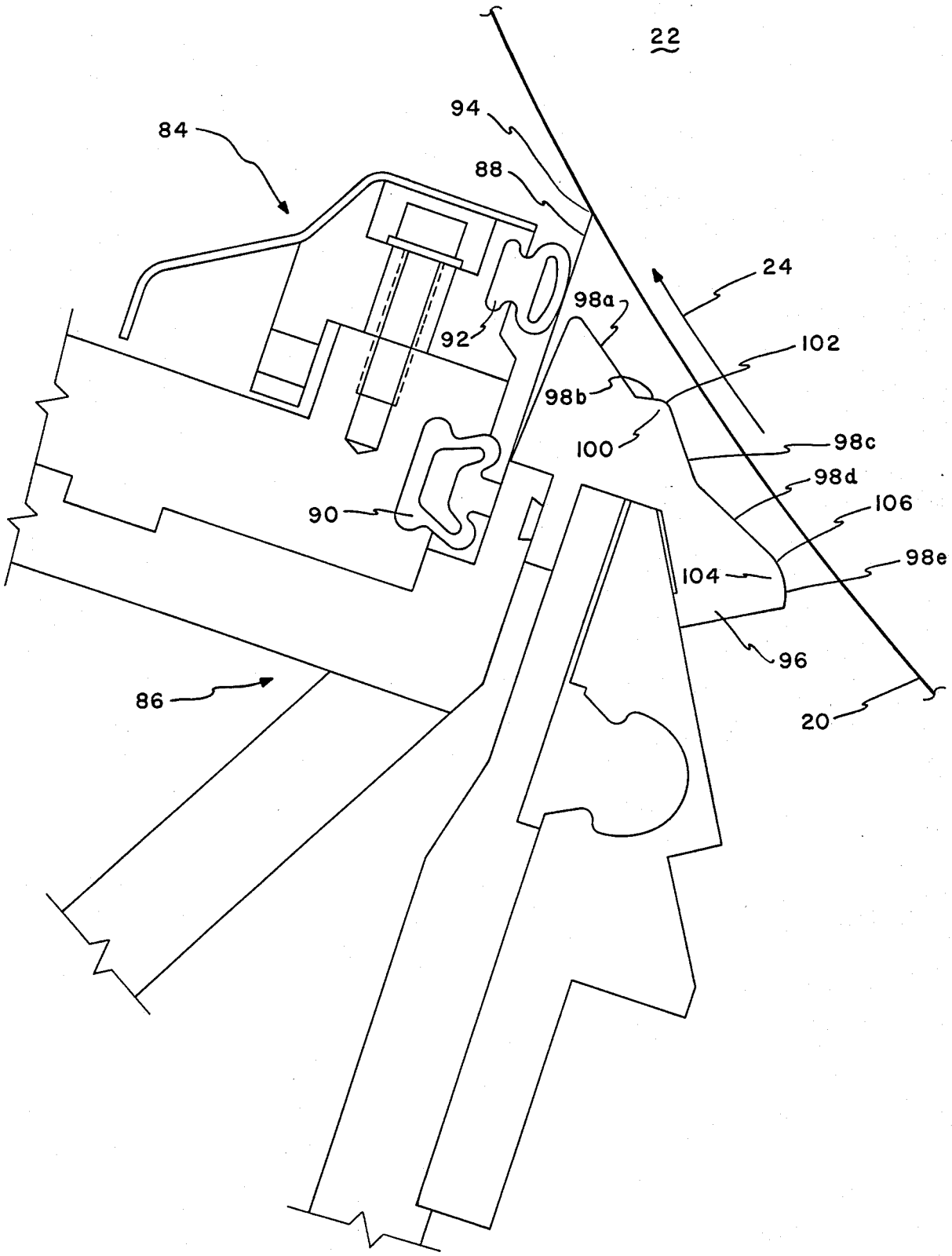
FIG. 4 illustrates a doctor assembly having a shear plate configured according to another embodiment of the invention.

FIG. 4 illustrates a doctor assembly, indicated generally at 84, in accordance with another embodiment of the invention. The assembly includes a main beam 86, to which a doctor blade 88 is clamped at its lower end by m means of a pneumatic tube 90, while a pneumatic tube 92 urges a tip 94 of the blade against the web 20. Upstream of the blade (in the direction of web travel) a dip roll applicator applies an excess layer of coating onto the surface of the web, and just upstream of the blade is a shear plate 96.

In this embodiment, the shear plate 96 has four surfaces 98a–e that define two ramps, one a downstream ramp 100 having a tip 102 and the other an upstream ramp 104 having a tip 106. As the excess coating layer carried on the web 20 strikes the doctor blade 88, excess coating removed by the blade bounces back away from the blade in the upstream direction and flows across the shear plate surface 98a. When the flow reaches the surface 98b it is deflected toward the web, and upon leaving the surface at the tip 102 of the first ramp 100, it impacts against the web along an application line extending transversely of the web. After impact, the coating bounces onto and flows across the surface 98c to the surface 98d, and is again deflected toward the web. The flow leaves the surface 98d at the tip 106 of the second ramp 104, and impacts against the web a second time along an application line extending transversely of the web. After impacting against the web for the second time, the flow is returned by any suitable means to the main supply of coating.

The compound shear plate 96 therefore causes the excess bladed coating to be impacted against the web twice. An advantage of the arrangement is that not only are nonuniformities in the excess coating layer on the web eliminated, but also double rewetting eliminates skip coating and improves coating lay on the web surface. As for the shear plates 56 and 74, the ramps 100 and 104 must not be so steep as to cause the area between the shear plate, web and doctor blade to fill with coating, while at the same time they must not be so shallow as to prevent proper impact of coating against and rewetting of the web.

Figure 5:
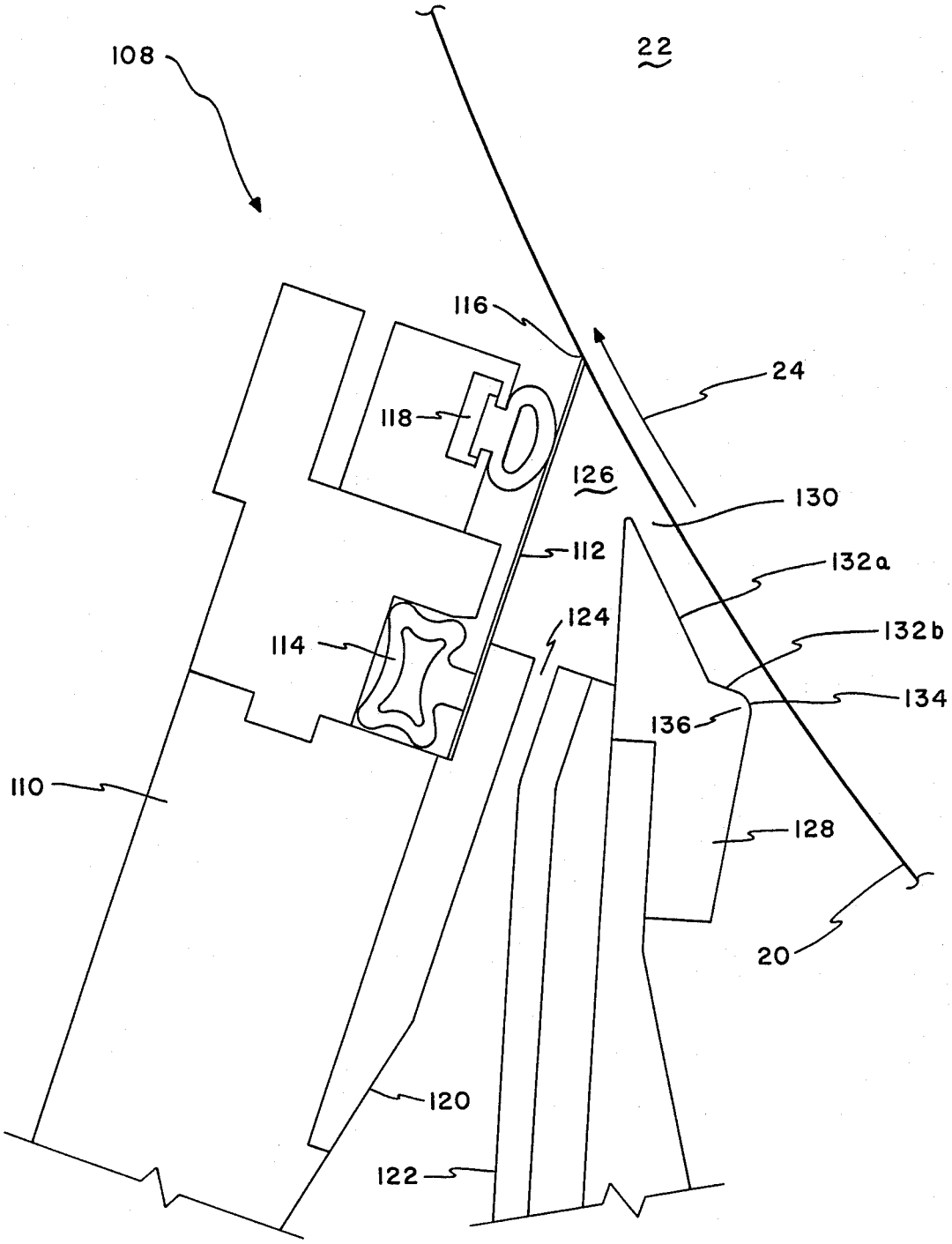
FIG. 5 shows a paper coater having a shear plate that forms a part of a coating applicator.

FIG. 5 shows an integral doctor assembly and coating applicator, indicated generally at 108. The assembly includes a frame 110 to which a doctor blade 112 is clamped at its lower end by a pneumatic tube 114, while a tip 116 of the blade is urged against the web 20 by a pneumatic tube 118. The frame has a rear wall 120 and a front wall 122 that converge together in the upward direction to define an elongate orifice 124, and coating material introduced under pressure into the space between the walls flows upwardly for exit through the orifice into an application zone 126 defined between the web, doctor blade, upper ends of the walls and a shear plate 128. The zone extends transversely across the web, and although not shown, edge seals are at opposite side ends of the zone. Except for the shear plate 128, the applicator is generally of the type disclosed in Damrau et al U.S. Pat. No. 4,250,211, assigned to the assignee of the present invention, the teachings of which are specifically incorporated herein by reference.

Irrespective of whether an excess layer of coating is applied onto the web 20 by an upstream dip roll applicator, coating material is introduced through the orifice 124 into the application zone 126 in sufficient quantity and at sufficient pressure to completely fill the zone and a gap 130, between the web and shear plate 128, with a reverse flow of coating from the zone to form a liquid seal in the gap and maintain coating liquid in the zone under pressure for pressurized application onto the web 20. The shear plate is configured so that the reverse flow of coating through the gap prewets the web prior to the application zone. The shear plate has two surfaces 132*a* and 132*b* facing the web, the surface 132*a* diverges from the web in the upstream direction, and the surface 132*b* converges toward the web until it terminates at a tip 134 of a ramp 136. As coating flows reversely through the gap in the upstream direction, upon encountering the surface 132*b* it is deflected toward and against the web along an application contact line extending transversely across the web. The application contact line is uniformly spaced along its length from the doctor blade tip 116, so the dwell time from wetting the web with coating to blading the coating on the web is very constant across the web and a very uniform coating lay is obtained. As compared to a conventional orifice plate, the shear plate 128 provides an improved coating on the resulting sheet.

While embodiments of the invention have been described in detail, various modifications and other embodiments thereof may be devised by one skilled in the art without departing from the spirit and scope of the invention, as defined in the appended claims.

What is claimed is:

1. A doctor assembly for metering and leveling an excess layer of liquid coating material carried on a surface of a paper web traveling at a relatively high rate of speed, said doctor assembly comprising a doctor blade having a tip extending against and across the web surface for doctoring the excess coating layer on the web; and a shear plate upstream of said doctor blade, said shear plate having a surface facing toward but spaced from the web and a ramp on said surface extending toward the web, whereby as the excess coating layer on the web contacts said doctor blade, excess coating removed from the web by said blade rebounds off of and away from said blade in the upstream direction, flows across said shear plate surface and is deflected by said ramp on said surface against the excess coating layer on the web, along a transverse application contact line upstream of said doctor blade, to rewet and smooth the excess coating layer on the web before it reaches said blade, so that the excess coating layer doctored by said blade on the web is very uniform, variations in impulse forces of the excess coating layer against said blade are minimized, and said blade doctors the coating on the web very uniformly.

2. A doctor assembly as in claim 1, wherein the excess coating layer is applied onto the web upstream of said doctor assembly by a dip roll applicator.

3. A doctor assembly as in claim 1, wherein the speed of travel of the web past said doctor assembly is at least 1200 fpm.

4. A doctor assembly as in claim 1, wherein the speed of travel of the web past said doctor assembly is greater than 2500 fpm.

5. A doctor assembly as in claim 1, wherein said shear plate ramp is spaced from the web by a distance on the order of $\frac{1}{8}''$ to $\frac{1}{2}''$.

6. A doctor assembly as in claim 1, wherein said shear plate ramp is spaced from the web by a distance on the order of 3/16″ to $\frac{3}{8}''$.

7. A doctor assembly as in claim 1, wherein said shear plate surface comprises a first generally planar downstream surface portion extending generally along the direction of travel of the web thereat, and a second generally planar surface portion upstream of, contiguous to and extending out of the plane of said first surface portion toward the web, said second surface portion defining said ramp.

8. A doctor assembly as in claim 7, wherein the web is carried past said doctor assembly on a backing roll, said doctor blade is angled at about 45° to a tangent to the web at the point of contact of said blade tip with the web, said first surface portion is oriented so that a perpendicular to the midpoint of its length passes at least close to the center of the backing roll, and said first and second surface portions define an included angle of about 135°.

9. A doctor assembly as in claim 1, wherein said shear plate has two ramps on its surface, one a downstream ramp closest to said doctor blade and the other an upstream ramp furthest from said doctor blade.

10. A doctor assembly as in claim 1, wherein said shear plate ramp comprises a portion of said shear plate surface that is angled toward the web to a tip of said ramp spaced from the web, and the angulation of said surface portion toward the web and the spacing of said ramp tip from the web are such as to prevent an accumulation of coating, removed from the web by said doctor blade, in an area defined between said blade, shear plate and the web.

11. A paper coater, comprising a dip roll applicator for applying an excess of liquid coating material onto a surface of a web of paper carried at a relatively high rate of speed across a surface of said applicator; and a doctor assembly downstream from said applicator, in the direction of web travel, for doctoring the excess coating layer on the web, said doctor assembly including a doctor blade having a tip extended against and across the web surface, and a shear plate upstream of said blade, said shear plate having a surface facing toward but spaced from the web and a ramp on said surface extending toward said web, whereby as the excess coating layer on the web contacts said blade, coating removed from the web by said blade rebounds off and away from said blade in the upstream direction, flows across said shear plate surface and is deflected by said ramp on said surface against the excess coating layer on the web, along a transverse application contact line upstream of said blade, to rewet, smooth and eliminate nonuniformities in the excess coating layer on the web before it reaches said blade, so that the excess coating layer doctored by said blade on the web is very uniform, variations in impulse forces of the excess coating layer against said blade are minimized, and said blade doctors the coating on the web very uniformly.

12. A paper coater as in claim 11, wherein the speed of travel of the web is at least 1200 fpm.

13. A paper coater in as claim 11, wherein said shear plate surface comprises a first generally planar downstream surface portion extending generally along the direction of travel of the web thereat, and a second generally planar surface portion upstream of, contiguous to and extending out of the plane of said first surface portion toward the web, said second surface portion defining said ramp.

14. A paper coater as in claim 1, wherein said shear plate has two ramps on its surface, one a downstream ramp closest to said doctor blade and the other an upstream ramp furthest from said doctor blade.

15. A paper coater for applying liquid coating material onto a surface of a moving web of paper, comprising a body defining a chamber therein and an elongate opening from said chamber positionable adjacent to and transversely across the web; a doctor blade carried by said body on a downstream side of said elongate opening and having a tip extending against and transversely across the web; a shear plate carried by said body on an upstream side of said opening, said shear plate having a surface facing toward but spaced from the web to define a gap therewith, said surface being elongate in the direction of web travel and having a ramp toward its upstream end, and said doctor blade, shear plate, upper end of said body and the web defining an application zone therebetween; means for sealing opposite side ends of said application zone; and means for introducing coating liquid into said chamber and through said elongate opening into said application zone in sufficient quantity and at sufficient pressure to completely fill said application zone with coating, to cause a reverse flow of coating through said gap that fills and forms a liquid seal in said gap, and to maintain a pressurized supply of coating in said zone for pressurized application of coating onto the web, said shear plate ramp deflecting the reverse flow of coating through said gap against the web along the application contact line extending transversely of and across the web to wet the web with coating along the applicaiton contact line, said ramp, and therefore the application line, being spaced a uniform distance along their length from said doctor blade tip, whereby the time from wetting the web with coating to doctoring of the coating is very uniform across the transverse extent of the web.

16. A paper coater as in claim 15, wherein said shear plate surface comprises a first generally planar downstream surface portion extending generally along the direction of travel of the web thereat, and a second generally planar surface portion upstream of, contiguous to and extending out of the plane of said first surface portion toward the web, said second surface portion defining said ramp.

17. A method of metering and leveling an excess layer of coating liquid on a surface of a moving web of paper, comprising the steps of extending the tip of a doctor blade against and transversely across the surface of the web to doctor the coating on and remove excess coating from the surface; moving the web at a speed of travel sufficient to cause excess coating contacting and removed from the web surface by the blade to rebound off of and away from the blade and to flow in an upstream direction; directing the excess flow of bladed coating against the excess layer of coating on the web along an application contact line extending transversely of the web upstream of the doctor blade to rewet and smooth the excess coating layer on the web before it reaches the doctor blade, so that the excess layer of coating on the web doctored by the blade is very uniform, variations in impulse forces of the excess coating layer on the web against the blade are minimized, and the blade doctors the coating on the web very uniformly; and preventing the excess bladed coating liquid from completely filling an area adjacent to the web and intermediate the doctor blade and application contact line.

18. A method as in claim 17, wherein said moving step comprises moving the web at a speed of travel of at least 1200 fpm.

19. A method as in claim 17, wherein said preventing step prevents coating liquid from filling the center of the area intermediate the blade tip and application contact line.

20. A method of metering and leveling an excess layer of coating liquid on a surface of a moving web of paper, comprising the steps of extending the tip of a doctor blade against and transversely across the surface of the web to doctor the coating on and remove excess coating from the surface; moving the web at a speed of travel sufficient to cause excess coating contacting and removed from the web surface by the blade to rebound off of and away from the blade and to flow in an upstream direction; directing the excess flow of bladed coating against the excess layer of coating on the web along an application contact line extending transversely of the web upstream of the doctor blade to rewet and smooth the excess coating layer on the web before it reaches the doctor blade, so that the excess layer of coating on the web doctored by the blade is very uniform, variations in impulse forces of the excess coating layer on the web against the blade are minimized, and the blade doctors the coating on the web very uniformly; and, after said directing step, redirecting the excess flow of coating liquid against the excess coating layer on the web along another application contact line extending transversely of the web upstream of the first mentioned application contact line.

21. A method of coating a surface of a moving web of paper, comprising the steps of applying an excess layer of liquid coating material onto the surface of the web with a dip roll applicator; extending the tip of a doctor blade against and transversely across the surface of the web downstream of the dip roll applicator to doctor the coating on and remove excess coating from the surface; moving the web at a speed of travel sufficient to cause excess coating contacting and removed from the web surface by the blade to rebound off of and away from the doctor blade and to flow in an upstream direction; directing the excess flow of bladed coating against the excess coating layer on the web along an application contact line extending transversely of the web upstream of the doctor blade to rewet, smooth and eliminate nonuniformities in the excess coating layer on the web before it reaches the doctor blade, so that the excess coating layer doctored by the blade is very uniform, variations in impulse forces of the excess coating layer on the web against the doctor blade are minimized, and the blade doctors the coating on the web very uniformly; and preventing the excess bladed coating from completely filling an area adjacent to the web and intermediate the doctor blade and application contact line.

22. A method as in claim 21, wherein said moving step comprises moving the web at a speed of travel of at least 1200 fpm.

23. A method as in claim 21, wherein said moving step comprises moving the web at a speed of travel in excess of 2500 fpm.

24. A method as in claim 21, wherein said preventing step prevents coating liquid from filling the center of the area intermediate the doctor blade tip and application contact line.

25. A method of coating a surface of a moving web of paper, comprising the steps of establishing an application zone of pressurized coating liquid against and transversely across the surface of the web for pressurized application of coating liquid onto the surface; doctoring the coating liquid on the surface of the web, at a downstream end of the application zone, along a line extending transversely of and across the web; flowing coating liquid from the application zone through a gap extending transversely across the web at an upstream end of the application zone; and directing the flow of coating liquid, after it has passed through and is upstream of the gap, against the surface of the web along an application contact line extending transversely of the web to wet the web with coating liquid, wherein the application contact line is generally parallel to the doctoring line, so that the time interval between wetting the web with coating to doctoring the coating is very uniform across the transverse extent of the web.

* * * * *